United States Patent [19]

Gram

[11] 4,342,205

[45] Aug. 3, 1982

[54] VERTICAL PLATE FREEZER

[75] Inventor: Hans Gram, Vojens, Denmark

[73] Assignee: Brodrene Gram A/S, Vojens, Denmark

[21] Appl. No.: 260,985

[22] Filed: May 6, 1981

[30] Foreign Application Priority Data

May 19, 1980 [DK] Denmark ..... 2177/80

[51] Int. Cl.[3] ..... F25C 5/14

[52] U.S. Cl. ..... 62/341; 100/93 P

[58] Field of Search ..... 62/60, 62, 63, 64, 341, 62/380, 381; 296/61; 100/93 P

[56] References Cited

U.S. PATENT DOCUMENTS

| | | | |
|---|---|---|---|
| 3,074,247 | 1/1963 | Polk | 62/341 |
| 3,242,684 | 3/1966 | Sola | 62/341 |
| 3,394,469 | 7/1968 | Eilenberg et al. | 62/341 |
| 3,895,498 | 7/1975 | Manthey et al. | 62/64 |
| 4,083,199 | 4/1978 | Gram | 62/341 |

*Primary Examiner*—Ronald C. Capossela

*Attorney, Agent, or Firm*—Watson, Cole, Grindle & Watson

[57] ABSTRACT

At each end of a row of freezer plates for a vertical plate freezer, a cylinder with a piston rod is arranged. The two piston rods are connected with each other by means of a beam which extends below the row of freezer plates and the beam is connected with movable bottoms arranged in the spacings between the freezer plates. The frozen material arranged in the spacings is moved upwardly for removal by means of the cylinders arranged at the ends and free access to the spacings between the freezer plates is achieved along both sides of the row of freezer plates.

1 Claim, 6 Drawing Figures

VERTICAL PLATE FREEZER

BACKGROUND OF THE INVENTION

The present invention relates to a vertical plate freezer of the type comprising a plurality of vertical freezer plates arranged side by side in rows with spaces therebetween, the spaces serving to receive the material to be frozen, and where vertically displaceable bottoms are arranged in these spaces, the bottoms being connected to a lifting device.

In the prior art plate freezers of this type the lifting device comprises a vertical rack extending along one side of the row of freezer plates and projecting well above same. The rack has projecting arms which support the displaceable bottoms, and all arms are linked to a vertically displaceable frame which is guided at each end in vertical guideways at the ends of the plate freezer. Since the rack for guiding the arms projects above the upper edges of the freezer plates, the plate freezer is accessible only with difficulty from one of the long sides. This limits the possibilities as regards the installation of the plate freezer in that it has to be observed that the side of the plate freezer opposite that of the lifting device will be oriented so as to allow optimum filling. Furthermore, this construction has the disadvantage that filling of material into the spaces between the freezer plates should preferably be made from the same side as the one from which the frozen material is removed.

SUMMARY OF THE INVENTION

The plate freezer according to the present invention is characterized in that the lifting device comprises two lifting mechanisms arranged at respective ends of the row of freezer plates, the lifting mechanisms being interposed between the frame of the plate freezer and a traverse mechanism extending under the row of freezer plates, and wherein the traverse mechanism is connected to each of the movable bottoms arranged between the freezer plates. This eliminates the need for a tall projecting rack, and, accordingly, access to the plate freezer is facilitated as it can now be served from both sides of the row of freezer plates.

The connections between the traverse mechanism and the movable bottoms may be simple rod connections. The latter, however, must have a length which when the traverse mechanism is moved vertically is sufficient to push the bottoms so high up in the spaces between the freezer plates that it becomes possible to remove the frozen material. This may necessitate such a tall plate freezer that it will be difficult to handle it when filling material to be frozen into the spaces and when removing the frozen material after this has been pushed up in the spaces, unless measures are taken to lower the floor under the freezer so that the traverse mechanism may be lowered into such a recess.

This problem, however, can be overcome according to the invention, i.e. by means of an embodiment which is characterized in that the traverse mechanism comprises a beam, where the connection between the latter and each of the bottoms is a telescopic bar whose one end is connected to the beam with its other end being connected to the bottom, and of a linkage whose one end is connected to the inner member of the telescopic bar with its other end being connected to a lever between the ends thereof, one end of said lever being connected to the outer member of the telescopic bar, and where the other end of said lever is guided relatively to a stationary part of the plate freezer. By this arrangement the telescopic bar of each bottom is extended automatically when the beam is lifted and the lever is guided as described.

A particularly simple embodiment of the plate freezer according to the invention is characterized in that each lifting mechanism comprises a hydraulic cylinder.

According to yet another embodiment of the invention, the plate freezer has two or more rows of freezer plates with two associated lifting mechanisms for each row.

DESCRIPTION OF THE PREFERRED EMBODIMENTS

Figure 1:
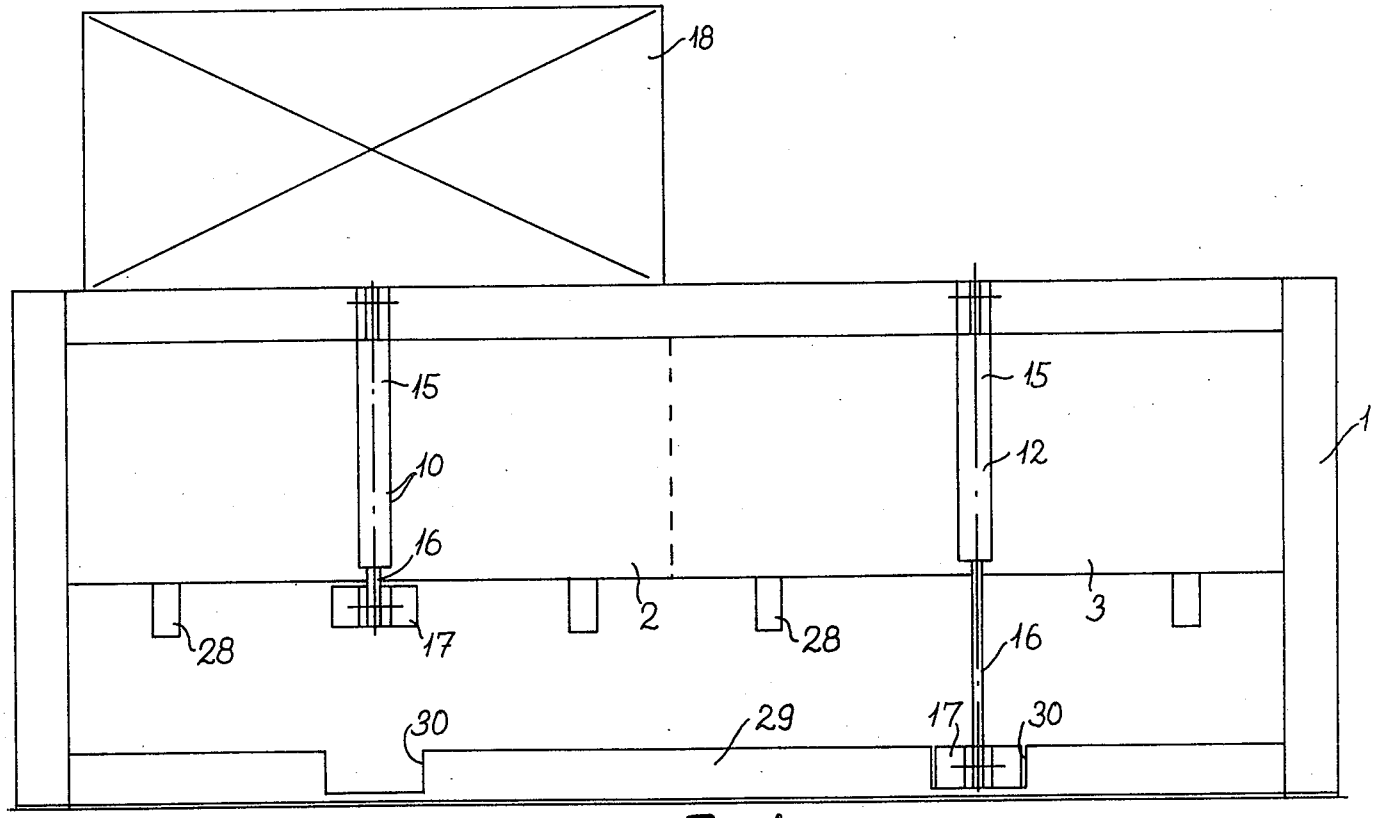
FIG. 1 shows an embodiment of the vertical plate freezer according to the invention, viewed from one end thereof, FIGS. 2A and 2B placed end to end represent a lateral schematic view of the plate freezer shown in FIG. 1.

In the drawing numeral 1 designates the frame of the plate freezer shown. This frame accommodates two rows of freezer plates, 2 and 3 respectively, the freezer plates of each row being spaced in relation to each other, and these spaces serving to receive the material to be frozen. The plate freezer is provided with means known per se for supplying freezing medium to the freezer plates and defrosting medium to the freezer plates after freezing. Furthermore, there is arranged at the end of each row of freezer plates a pressure retaining mechanism 4, which is likewise of a type known per se, and which is interposed between the frame 1 and the outermost plate of each row. This mechanism serves to hold the plates together during filling of the spaces therebetween and during initial freezing of the products introduced and to allow the plates to move slightly away from each other as freezing progresses and the products expand. The mechanism 4 further serves in a manner likewise known per se to pull the freezer plates away from each other when the frozen material is to be removed from the spaces.

Figure 3:
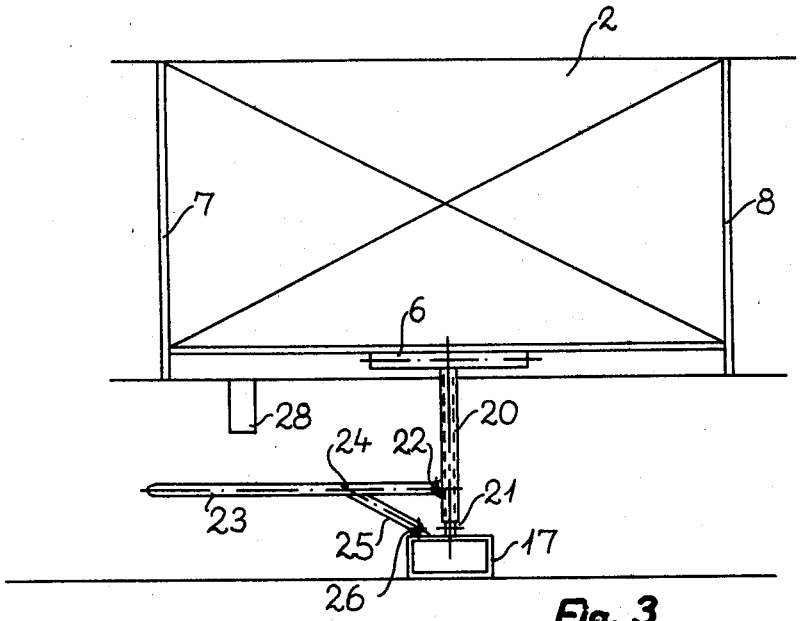
FIG. 3 shows schematically a part of a cross section of the plate freezer to illustrate a telescopic mechanism in its telescoped position.
Figure 5:
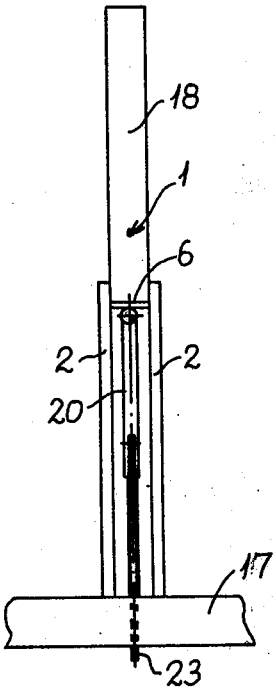
FIG. 5 is a left-hand view of the mechanism shown in FIG. 4.
Figure 4:
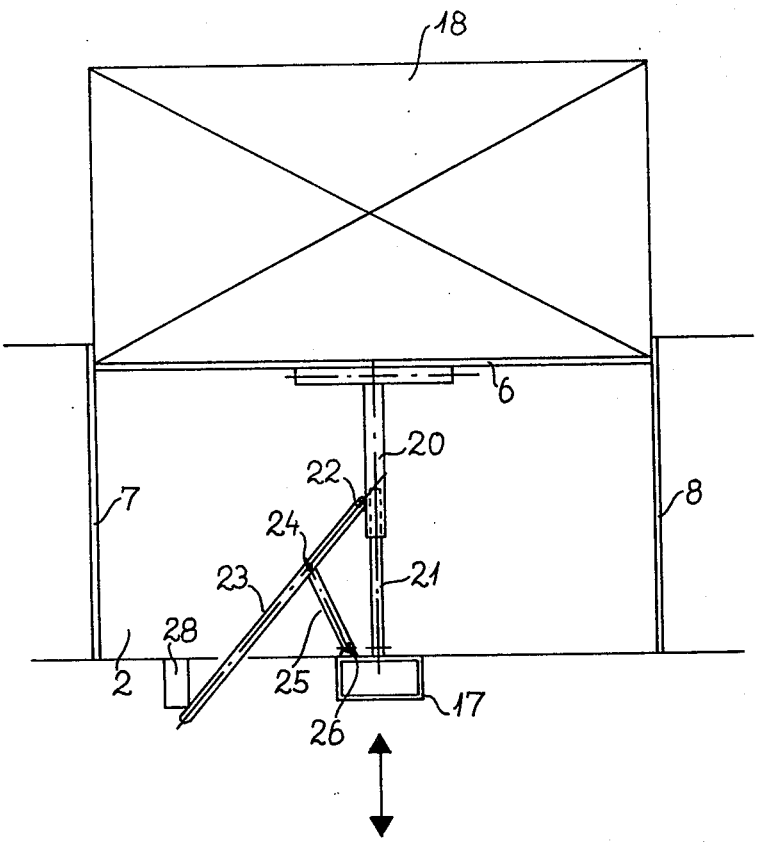
FIG. 4 is a view corresponding to FIG. 3 but with the telescopic mechanism in its extended position.

In each space between the two rows of plates 2 and 3 there is arranged a vertically movable bottom 6, FIG. 3, which in the filling position of the plate freezer seals the space downwardly. The space is sealed along the sides in a manner known per se by means of walls 7 and 8, as indicated in FIGS. 3 and 4. After filling and when the material has been frozen and thawed loose from the freezer plates, the bottoms 6 are moved to the position shown in FIG. 4, the discharging position.

Figure 2A:
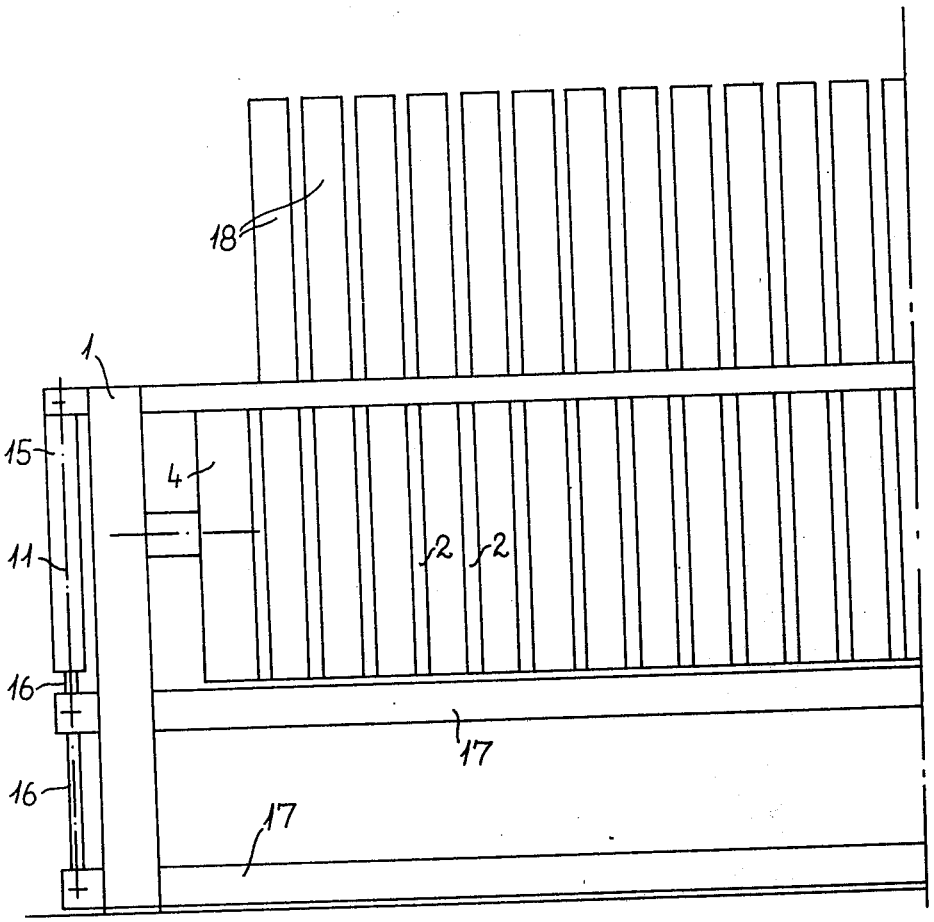
Figure 2B:
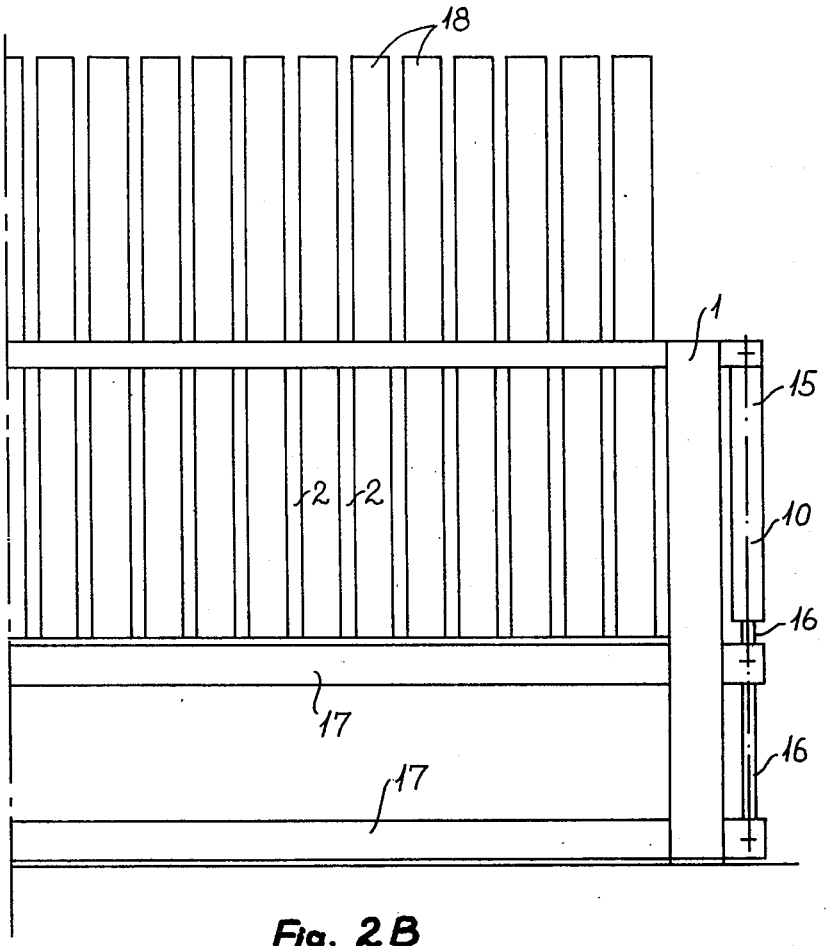

For providing this vertically reciprocating movement of the bottoms 6 of each row of freezer plates, the plate freezer incorporates for each row of freezer plates, 2 and 3 respectively, a lifting device comprising two lifting mechanisms, each designed as a cylinder mechanism. In FIGS. 2A and 2B the two lifting cylinders for the row of freezer plates closest to the viewer are designated 10 and 11 respectively. These two cylinder mechanisms 10 and 11 are associated with the row of freezer plates constituted by the freezer plates 2. The row of freezer plates constituted by the freezer plates 3 likewise includes at each end a cylinder mechanism, one of which is visible in FIG. 1, being designated 12.

Due to the fact that in the embodiment shown the lifting devices for the two rows of freezer plates, 2 and 3 respectively, are identical, only the lifting device for the row of freezer plate 2 will be explained for the sake of simplicity, i.e. the two cylinder mechanisms 10 and 11. One end 15 of these cylinder mechanisms is connected to the frame 1 at the upper edge thereof, and the piston rods 16, 16 of the cylinder mechanisms are connected to a traverse mechanism 17, which in the embodiment shown in the drawings is formed as a beam and extends under the row of freezer plates 2. In FIGS. 2A and 2B and in FIG. 4 the beam is shown in its raised position, which means that completely frozen products 18 in the form of slabs have been pushed nearly out of the spaces between the freezer plates 2.

By virtue of this arrangement of the cylinder mechanism 10, 11 at each end of the plate freezer there is no need for upwardly projecting parts of the lifting device along one side of the row of freezer plates, for which reason the plate freezer becomes readily accessible. This feature is especially important in the present case with two rows of freezer plates but is also of considerable importance where there is only one row as both sides of the freezer may conveniently be used; one for filling up with products to be frozen and the other one for removing the frozen products.

Each beam 17 may be connected to the associated row of bottoms 6 by means of simple rod connections, but in that case the lower edges of the freezer plates must be sufficiently raised above the floor on which the plate freezer is standing to allow the beam 17 to perform a displacing movement with a stroke generally corresponding to the height of the freezer plates. This may be inconvenient in case of tall freezer plates, for which reason the embodiment of the plate freezer shown in the drawings has been given a special design with reference to the connection between each bottom 6 and the associated beam 17. This connection is formed by a telescopic bar comprising a tube 20 which is connected to the lower side of the bottom 6 and a rod 21 displaceable in the tube and connected to the associated beam 17. One end of a lever 23 is secured to the tube 20 by means of a hinge 22, and one end of a linkage 25 is connected to the lever 23 between the ends thereof by means of a hinge 24, the other end of the linkage being connected by means of a hinge 26 to the beam 17, i.e. the rod 21.

The mode of operation of this special connection will be clearly understood by comparing FIG. 3 with FIG. 4. When the beam 17 is raised from the position shown in FIG. 3 to that in FIG. 4, the lever 23 will encounter and be guided by a stationary part 28 of the plate freezer, viz. in this case a longitudinal beam extending along the lower edges of the freezer plates. During the continued lifting movement of the beam 17 the lever 23 will be swung from the position shown in FIG. 3 to that in FIG. 4, from which will be seen that the lever 23 by virtue of its connection to the tube 20 and by virtue of the linkage 25 with the beam 17 will urge the tube 20 of the telescopic bar upwardly in relation to the rod 21. This will considerably increase the lifting ratio of the bottom 6 in relation to the lifting movement of the beam 17 and accordingly, in relation to the length of the stroke of the cylinder mechanisms 10 and 11.

At the same time the upper edge of the frame 1 of the plate freezer may be positioned at a low height, whereby filling and discharging of the freezing spaces are facilitated. As an added feature to maintain a low constructional height there are provided in transverse floor members 29, forming parts of the frame 1 of the plate freezer, recesses 30 for receiving the transverse beams 17.

The double-row design of the plate freezer shown in the drawings has the practical advantage of allowing thawing, discharging and filling operations in respect of one row of freezer plates 2 while freezing is being made in the second row of freezer plates 3.

I claim:

1. A contact freezer apparatus including vertically disposed freezer plates and means for supplying freezing medium thereto for freezing and for supplying defrosting medium thereto after freezing, the apparatus comprising frame means for slideably supporting a row of the plates in spaced apart relationship, means for moving the plates transversely within said frame means for adjusting the spacings between the plates, lifting devices supported by said frame means at opposite ends of said row of plates, beam means extending beneath said row of plates being interconnected with said lifting devices, bottom plates located in the spaces between adjacent freezer plates and lying above said beam means, linkage devices interconnecting said bottom plates with said beam means, each said linkage device comprising an extendable telescoping bar including a tube and a rod, a free end of said tube being connected to a corresponding one of said bottom plates and a free end of said rod being connected to said beam means, a tranversely extending lever hingedly connected at one end to said tube, and a linkage element hingedly interconnected at opposite ends respectively to said lever between opposite ends thereof and to said beam means, a fixed abutment means on said frame means disposed above said lever of each of said linkage devices outwardly of said linkage element, whereby upon operation of said lifting devices, said beam means is elevated and said lever of each of said linkage devices is caused to pivot upon engagement with said abutment means to thereby extend said tube of each said linkage device into each said space between said adjacent freezer plates for raising each said bottom plate upwardly between said freezer plates.

* * * * *